US005294069A

United States Patent [19]

Blahnik

[11] Patent Number: 5,294,069

[45] Date of Patent: Mar. 15, 1994

[54] MEDIA FEED AND ROLLER DEVICE FOR AN ELECTROGRAPHIC PRINTER

[75] Inventor: Jeffrey C. Blahnik, Gilroy, Calif.

[73] Assignee: Xerox Corporation, Stamford, Conn.

[21] Appl. No.: 871,875

[22] Filed: Apr. 21, 1992

[51] Int. Cl.[5] ..... B65H 19/20; B65H 75/28

[52] U.S. Cl. ..... 242/56 R; 242/68.4; 242/72 R

[58] Field of Search ..... 242/56 R, 72 R, 74.1, 242/68.4, 66, 67.2; 355/28, 29

[56] References Cited

U.S. PATENT DOCUMENTS

| | | | |
|---|---|---|---|
| 3,208,684 | 9/1965 | Ramstein | 242/67.1 R |
| 3,580,522 | 5/1971 | Hansen et al. | 242/56 |
| 4,447,016 | 5/1984 | Enberg et al. | 242/72 R X |
| 4,456,209 | 6/1984 | Calizano et al. | 242/72 R X |
| 4,569,584 | 2/1986 | St. John et al. | 355/244 |
| 4,784,345 | 11/1988 | Romanowski et al. | 242/66 |
| 4,790,491 | 12/1988 | Mundus et al. | 242/68.4 |
| 4,838,497 | 6/1989 | Kramer et al. | 242/67.2 |
| 4,858,844 | 8/1989 | Stenqvist | 242/67.1 R |
| 4,913,367 | 4/1990 | Hata | 242/68.4 X |
| 5,011,093 | 4/1991 | Mayer et al. | 242/56 R |
| 5,037,037 | 8/1991 | Mayer et al. | 242/67.2 |
| 5,060,880 | 10/1991 | Mayer | 242/75.2 |

*Primary Examiner*—Peter Nerbun

*Attorney, Agent, or Firm*—Lisa M. Yamonaco

[57] ABSTRACT

Apparatus for automatically feeding and rolling output media from a printer. The apparatus comprises a supply roll for supplying a recording media having a leading edge, a clamping assembly for clamping the leading edge of the recording media, the clamping assembly also supplying a surface for the media to roll thereon. The apparatus further comprises an assist drive roller assembly for driving the leading edge of the recording media into the clamping assembly, a differential drive assembly for driving the clamping assembly to allow the recording media to be rolled thereon, and a retract assembly for retracting the clamping assembly to allow the clamping assembly to be removed from the recording media, after the media has been rolled onto the clamping assembly, causing the recording media to drop.

10 Claims, 7 Drawing Sheets

MEDIA FEED AND ROLLER DEVICE FOR AN ELECTROGRAPHIC PRINTER

BACKGROUND OF THE INVENTION

The present invention relates to an apparatus for automatic feeding and rolling output recording media from an electrographic printer onto individual hubs or spools. More particularly, it relates to an apparatus into which recording medium is self threaded and clamped which provides constant tension on the medium during unidirectional or bidirectional movement of the medium through the printing apparatus and easy release of spooled plot.

The electrographic recording process, for which the apparatus of this invention is particularly applicable, includes the steps of forming an electrostatic latent image upon a recording medium and subsequently making the latent image visible. The recording medium, usually provided in web form, has a dielectric and a conductive surface and may be a coated paper, a polyester based transparent film, or other suitable material on which an electrostatic latent image is formed by means of a plurality of writing electrodes or styli physically positioned on one side thereof to electrically address the dielectric surface as the medium travels therepast through a recording station. Opposite the dielectric surface of the recording medium there is a conductive surface which in some cases is grounded. When the potential difference between the conductive surface and the recording elements is raised above a threshold level, on the order of several hundred volts, an electrostatic charge is deposited on the dielectric surface of the recording medium as the medium passes by the recording elements.

Subsequently the latent image is made visible during the development step by applying liquid or dry toner to the recording medium. Normally such electrographic apparatus includes a liquid development system comprising a roller applicator movable through a bath of toner particles suspended in a carrier liquid, or a fountain over which a marking liquid flows. In each case, the recording medium is contacted by a thin film of developer material out of which the toner particles are electrostatically attracted to the regions of electrostatic charge on the medium.

Electrostatic plotters of this type have been commercially successful for many years in a monochrome mode, including a single recording station and a single development station dispensing a single color toner, usually black. More recently, electrostatic color plotters have been available to produce full color plots by the sequential overlaying of a series of separate color images (yellow, cyan, magenta and black) to produce a full spectrum of colors. It is clearly imperative that each color separation image must be in registration with the preceding images so as to prevent color fringes and color errors, and to provide high resolution color prints.

There are two basic approaches to color separation imaging. In one, a series of images are formed each by means of a dedicated recording head and development station. In the other, a single recording head forms each color separation image on the recording medium which is then advanced past one of the development stations. Then, the recording medium is returned to the recording head for receiving the next color separation image and is advanced to the next development station. This process of advancing and returning the recording medium through the apparatus minimizes the number of recording heads and obviates the need for their critical alignment with respect to one another. On the other hand, it is very important that great care be taken during shuttling of the recording medium back and forth (i.e. bidirectionally) to insure that it does not mistrack or skew in the apparatus, resulting in color-to-color mismatch.

The web of recording medium, in each case, is dispensed from a supply roller to the image processing stations. In the single pass method, handling of the recording medium is greatly simplified as compared with the multiple pass method, since although a completed plot may be wound onto a take-up spool, it is also possible to feed it out of the machine with no provision for output storage, i.e. feeding onto the floor. This is not the case with the multiple pass method since the recording medium must be under positive control in two directions of movement before a completed plot may be achieved.

As illustrated and described in U.S. Pat. No. 4,569,584 to St. John et al., advancing and rewinding of the recording medium, in a multicolor electrographic plotter, is accomplished by feeding the medium from a supply roller to a take-up roller and by driving it with an intermediate main drive roller. The supply roller and the take-up roller each are continuously biased in opposite directions by individual drive motors so as to maintain the medium in a taut state of equilibrium which may be overcome by the drive motor applied to the main drive roller. Winding the completed plots onto a take-up spool, as taught in the '584 patent, is satisfactory for many applications but it requires that numerous completed plots be serially wound upon the take-up spool, prior to separating them into the individual plots and delivering them to their respective recipients.

U.S. Pat. Nos. 5,011,093, 5,037,037, to Mayer et al., and 5,060,880 to Mayer each disclose an apparatus for spooling output media into individual rolls thus eliminating the need to wind several prints into one roll. There is a drive motor for bidirectional driving the medium in and out of the spooling apparatus to allow for multiple pass printing. However, such a device does not have positive control of the leading edge of the media. Therefore, media skew may become a problem during the color printing process.

Other forms of an output spooling stations are shown and described in U.S. Pat. No. 4,784,345 to Romanowski et al. and U.S. Pat. No. 4,838,497 to Kramer et al. In the single pass apparatuses described therein, sheets of recording media are transported through a document reproduction apparatus and are delivered into a device for automatically rolling the sheets into tubular form. No provision is made for maintaining the medium taut as it is moved into the device. Furthermore, neither device described has the ability to move the media bidirectionally to allow for multipass color printing.

Often it is desired to obtain an output plot of one's work shortly or immediately after it has been printed on a centralized plotter at a remote location. In such a case, it would be most convenient if the plotter apparatus had the capability to automatically provide individual plots from the supply web and to deliver them in rolled up, tubular form for ease of handling. Therefore, it would be advantageous to provide a system providing an automatic spooling apparatus which will maintain the record medium taut in both directions of movement so as to prevent mistracking thereof and to allow for multipass color printing. Furthermore, it would be advantageous to provide an automatic spooling apparatus which is self threading and has positive control of the leading edge of the media and easy release of spooled plot. Such a system could be cost effective, accommodate a limitless plot length and would not be affected by media types or stiffness.

SUMMARY OF THE INVENTION

In accordance with the present invention, provided is an apparatus for automatically feeding and rolling output media from a printer, comprising: supplying means for supplying a recording media having a leading edge; clamping means for clamping the side portions of the leading edge of the recording media, the clamping means also supplying a surface for the media to roll thereon; driving means for driving the leading edge of the recording media into the clamping means; driving means for driving the clamping means to allow the recording media to be rolled onto the clamping means; and, retracting means for retracting the clamping means allowing the clamping means to be removed from the recording media after the media has been rolled onto it causing the recording media to drop.

DETAILED DESCRIPTION OF THE INVENTION

Figure 1:
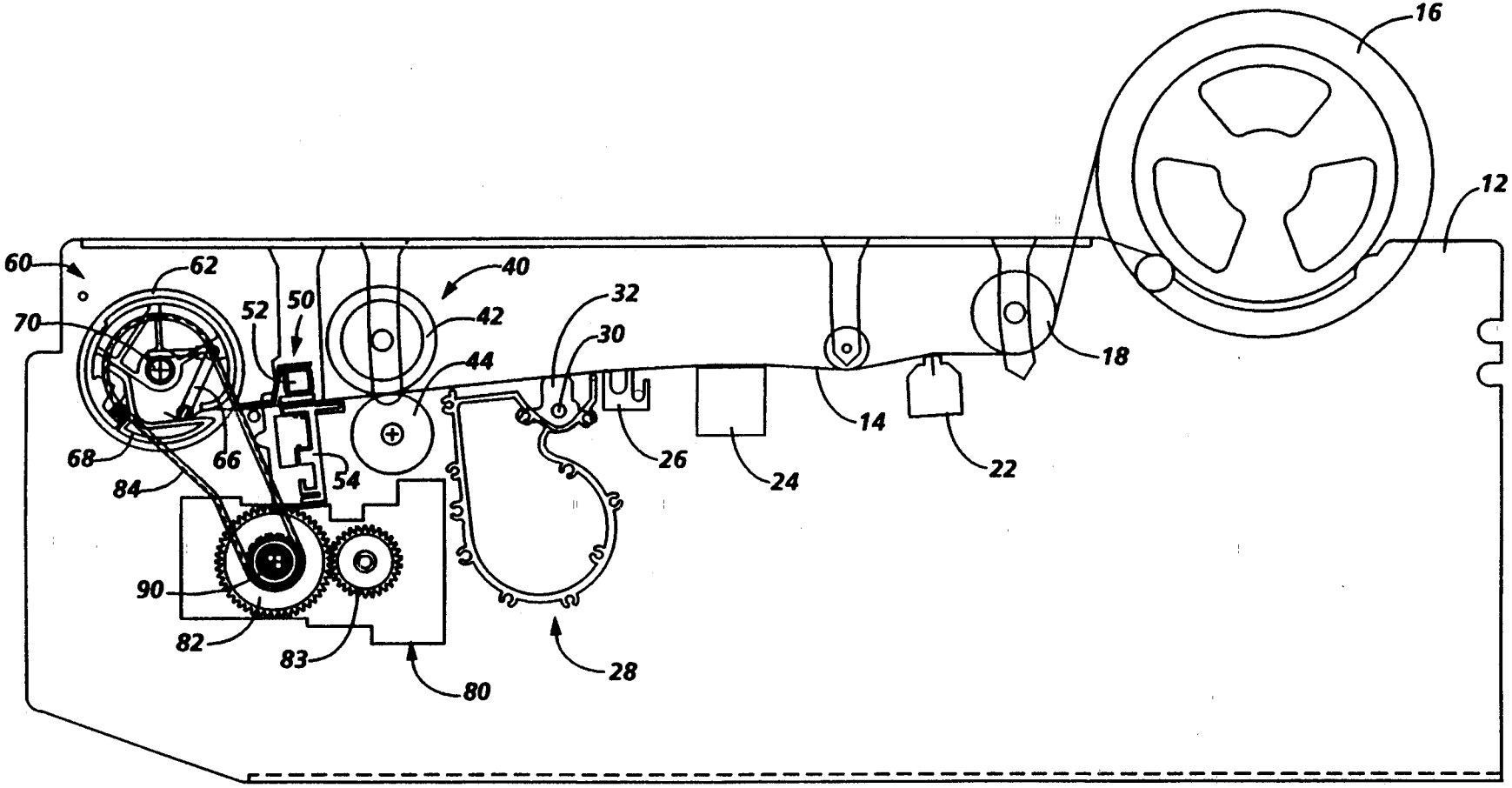
FIG. 1 is schematic right side view depicting an electrographic plotter utilizing the present invention.

FIG. 1 is a right side view of a four color electrographic plotter 10 depicting the media path and incorporating the present invention. In general, media 14 is paid from supply roll 16 and threaded through the media path of plotter 10 as shown. From supply roll 16, media 14 goes under encoder turn bar 18 which tracks velocity and positioning of media 14 as it moves through the media path. Media 14 passes under encoder bar 18 then over electrostatic write head 22 where write head 22 charges media 14 for later development. After charging, media 14 passes over toning fountain 24 for development and on to primary drying channel 26 and secondary drying station 28. Primary drying channel 26 is a vacuum channel which basically sucks off the bulk of the residual toning fluid left on the media 14 after toning. 85%-90% of the residual toning fluid gets taken off media 14 by primary drying channel 26. Secondary drying station 28 incorporates the use of a tubular quartz lamp 30, mounted in a parabolic reflector 32 which irradiates heat thus heating any residual toning fluid left on media 14. Secondary drying channel 28 extends across the entire length of plotter 10 and is filled with air blowing through it to actually evaporate the residual fluid from media 14.

Media moves through the assist drive roller assembly 40 which consists of assist drive roll 42 and assist backup roll 44. Assist roll 42 is the primary drive force for media 14 when traveling in the forward direction. This drive force will occur at the center fifteen inches of media 14 where a fifteen inch band of urethane, or similar material, is bonded to the outside diameter of assist drive roll 42. Drive to media 14 from assist drive roller assembly 40 will thus be a simple pinch with no wrap around drive roll 42, except for a small amount of wrap that occurs when the urethane deflects against backup roll 44.

Downstream of assist drive roller assembly 40, media 14 then travels through a two piece cutter assembly 50. Cutting of media 14 is performed via two round hardened cutter wheels sliding and rolling against a long hardened steel blade. This format is most commonly known as a "pizza wheel" cutter. This version, is split into two pieces, upper cutter assembly 52 which is spring loaded and loosely mounted in the lid, and lower cutter assembly 54, including the cutter wheel assembly mounted on the base.

During media loading, the left and right sides of the leading edge of media 14 are directed into left and right clamp drive tube assemblies 60, where the leading edge of media 14 is clamped. There are two clamp drive tube assemblies 60, one on each side of plotter 10 for receiving the side portions of the leading edge of the media. Clamp drive tube assembly 60 and related mechanisms will be described in detail below.

When loading a new roll of media 14, it must be threaded through the media path. When installing a new roll, the lid of the plotter is lifted up, and an operator threads the lead edge of the media past the blade of cutter assembly 50. Once the lid is closed, cutter assembly 50 will cut the overhanging strip of media from the roll leaving the newly cut lead edge of the media at its proper starting position which is right at cutter assembly 50. The operator then pulls the cut tail out and throws it away. The threading of media 14 only has to be done once per loading of a media roll. From then on, the operation of having the lead edge in the proper place at the cutter assembly is automatic. The positioning of the media lead edge at cutter 50 allows plotter 10 to know the positioning of media 14 at all times. One of the major design advantages of this system is that it is easy to load and use.

When the media 14 is loaded, plotter 10 is ready to receive raster data from an outside source such as a computer or over a communication line for plotting. In an idle condition, the front edge of media 14 is located at the edge of cutter assembly 50 where it had previously been cut off. When plotter 10 has data and is ready to plot, assist drive roll assembly 40 is energized, and actually pulls media 14 from supply roll 16 driving the leading edge of media 14 into clamp drive tube assembly 60 where a clamp mechanism has been raised awaiting the leading edge of the media. When the leading edge of media 14 is loaded into clamp drive tube assembly 60, a processor controlling the operation of plotter 10 urges clamp arm 66 against clamp support 68 trapping media 14 and causing the diameter of clamp drive tube assembly 62 to be increased to a predetermined circumference. Once the lead edge of the media has been clamped, plotter 10 is ready to start plotting.

Clamp drive tube assemblies 60 and assist drive roller assembly 40 both become active drive components in plotter 10 and pull media 14 through the machine. In plotter 10, clamp drive tube assembly 60 shares about 40% of the worst case load, while the rest is compensated for by assist drive roll assembly 40. In the past, in plotters with drive rollers and take-up devices, the take up device did not share a significant portion of the load.

With media 14 loaded and clamped into clamp drive tube assembly 60, plotter 10 is ready to plot. During the first pass of a color plot, media 14 is fed forward a predetermined distance, depending on the length of the plot being plotted, and registration marks are plotted on media 14 which are to be used for registration of each of the color separations to be printed to ensure proper alignment between passes. When plotter 10 has completed marking the registration marks, media 14 is then rewound onto supply roll 16 by a supply roll motor (not shown). During this rewind time, toning fountain 24 will be flushed. In this plotter, all four colors are passed through single toning fountain 24. In between the plotting of each color, the entire toning system is flushed with clear ISOPAR ® (Exxon Co.)

In subsequent passes, raster data is transmitted and media 14 is pulled through plotter 10 and the clamp drive tube assembly 60 never releases media 14. In other words, the lead edge of the media is still clamped by clamp arm 66. This process is repeated four times, once for each color separation of black, cyan, magenta and yellow. Although four passes and colors are described, any number of passes and colors can be envisioned.

As will become apparent, once plotting is complete, media 14 remains rolled up on clamp drive tube assembly 60. The machine processor then sends a signal to feed media 14 out to a known point. The processor sends a cut command to cutter assembly 50 and media 14 is cut. Clamp drive tube assembly 60 is then indexed to a particular position, so that the tail of the media which is sticking out at cutter assembly 50 will be rolled up with the finished plot before the plot is dropped into a bin. An example of a bin is shown in U.S. Pat. No. 5,037,037 to Mayer et al. which is hereby incorporated by reference.

Turning now to detailed descriptions of the subsystem assemblies of plotter 10. Media registration is different than in past plotters in that there is no dynamic or active media steering method in plotter 10 described herein. Media 14 is pulled off of supply roll 16, wrapped up onto the two clamp drive tube assemblies 60, and rewound back onto supply roll 16 for each plotting pass. There is no attempt to steer the media 14 within the media path since there is less chance for the media to skew because the drive system is pulling media 14 as opposed to pushing media 14 as in past systems. With this drive system, one actually has physical control of the leading edge of media 14, which is being controlled by clamp drive tube assembly 60. Because there is less chance of media skewing active steering may not be necessary. This lack of necessary steering control has major cost and performance advantages over prior designs.

Assist drive roller assembly 40, as seen in FIG. 1, provides all the velocity control for media 14 during an active plot. Web tension is controlled at supply roll 16 so that it does not go too high or too low. As can be appreciated, specific web tensions over write head 22 and toning fountain 24 are necessary. As previously mentioned, assist drive roller assembly 40 is a pinch system. Pure normal force between assist drive roll 42 and assist backup roller 44 provides the coupling to media 14 and thus the friction force to pull it. By decreasing the unit pressure loading on the media by 100%, assist roller assembly 40 has been designed to eliminate the problem of pinch roller markings which is prevalent in previous machines. The motor controlling supply roll 16 pulls on media 14 during retract or rewinding. Since a certain web tension may be required during rewind, the internal friction of the motors in assist drive roller assembly 40 and clamp drive tube assembly 60 will suffice.

Figure 2:
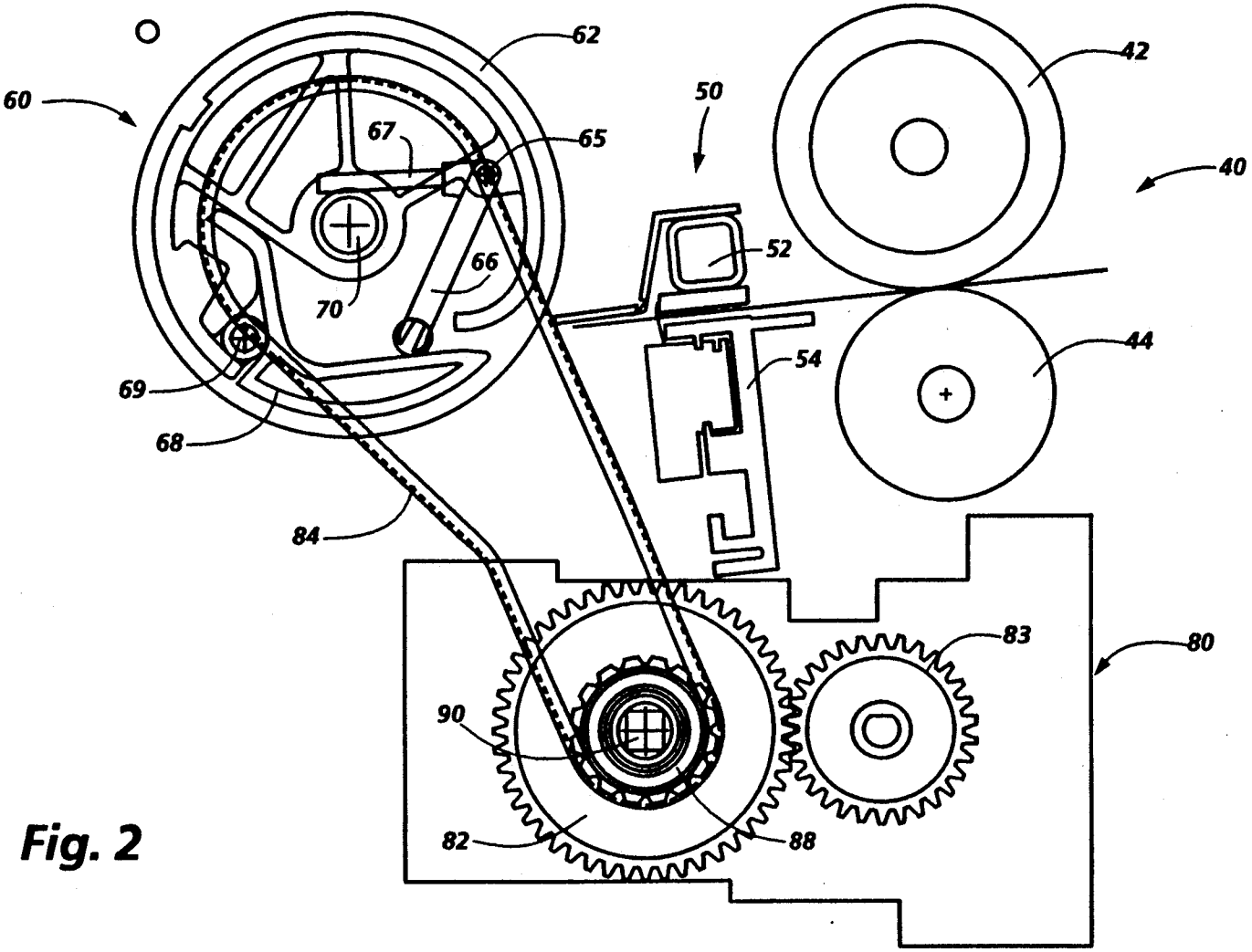
FIG. 2 is an enlarged partial schematic right side view of electrographic plotter of FIG. 1 including the differential drive assembly and the media feed and roller device of the present invention.
Figure 3:
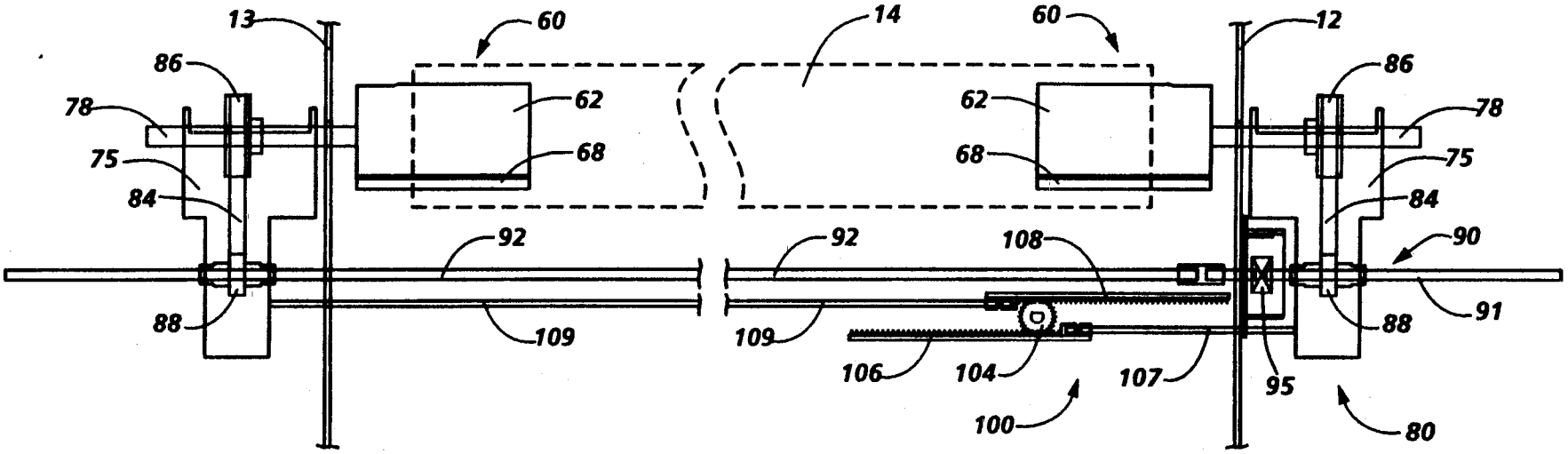
FIG. 3 is a schematic front view of the electrographic plotter of FIG. 1 with the retract assembly in the home position.

Referring to FIG. 2, shown is differential drive assembly 80 for clamp drive tube assemblies 60. Differential drive assembly 80 is required to provide equal tension on both sides of media 14 when media 14 is clamped by clamp drive tube assemblies 60 and when media 14 is just beginning to roll up onto the two clamp tubes 62 as seen in FIG. 3. Tension from both clamp drive assemblies 60 has to be equal in order to pull media 14 without skew through plotter 10. The differential is a force and distance integrator tending to balance the loads in terms of motion. After media 14 wraps around clamp tubes 62 a few times, differential drive assembly 80 discontinues its differential driving and changes from a differential drive to a solid drive by virtue of the rolled up media being stiff enough so that there is no more differential action.

Differential drive assembly 80, as seen best in FIG. 2, includes main gear 82, secondary gear 83, pulley 88, and pulley 86 connected by belt 84, and square differential drive shaft 90. Differential drive assembly 80, as best seen in FIGS. 2 and 3, includes a drive motor (not shown) which drives a square differential drive shaft 90 comprising a right side shaft portion 91 and a left side portion 92. Right side portion 91 extends into differential housing 95 where it is connected with the left side shaft portion 92 through differential gearing. Assembly 80 is designed so that right side differential drive shaft 91 provides direct torque to drive pulley 88 on the right side of plotter 10. Left side portion 92 provides direct torque to drive pulley 88 on the left side of plotter 10. Drive pulley 88 is connected to drive pulley 86 on clamp drive tube assemblies 60 via drive belt 84. The differential drive will allow the two clamp drive tube assemblies 60 to be driven with the same amount of torque during the first few wraps of media 14 around both drive tube assemblies 60.

Figure 4:
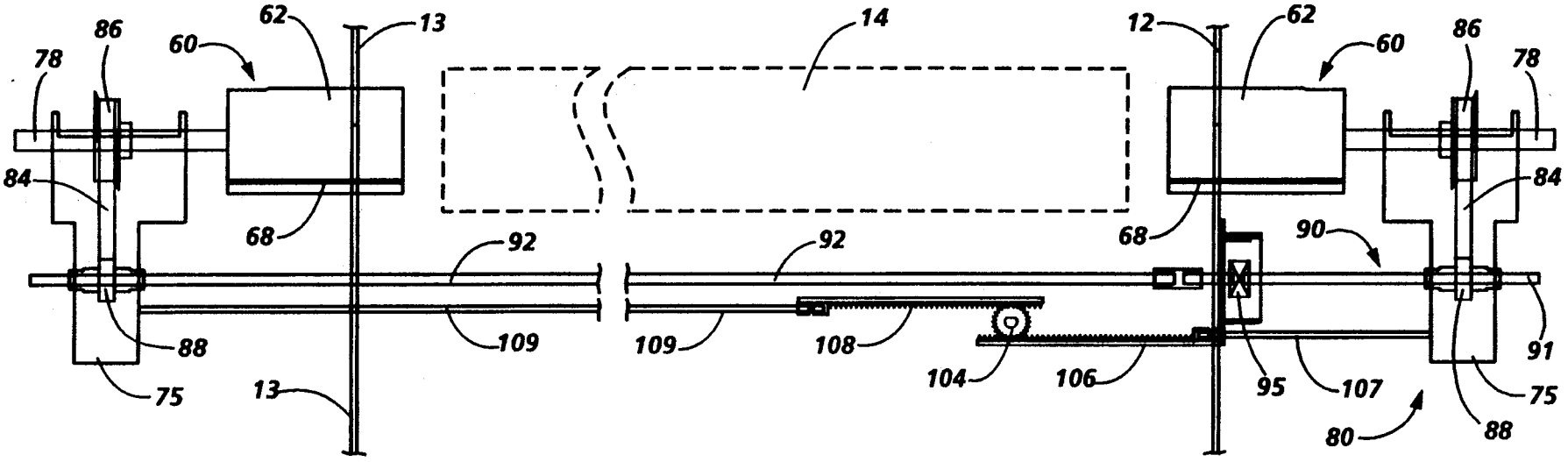
FIG. 4 is a schematic front view of the electrographic plotter of FIG. 1 with the retract assembly in the extended position.
Figure 5B:
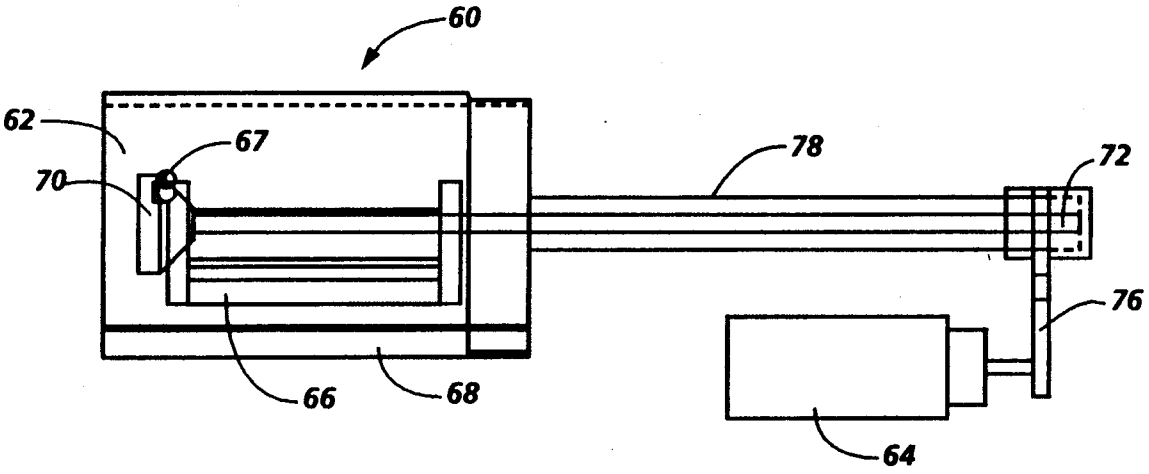
FIGS. 5*a* and 5*b* are detailed schematic views of the clamp drive tube assembly of the present invention in the media loading or unclamped position.
Figure 5A:
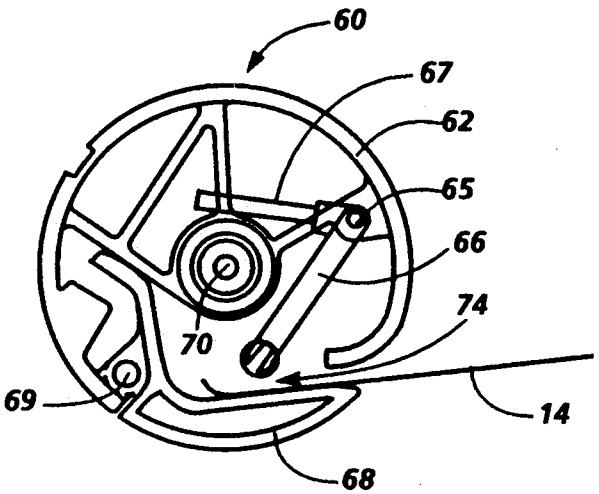

Turning now to retract assembly 100 shown in FIGS. 3 and 4. The purpose of retract assembly 100 is to remove clamp drive tubes 62 from the ends of a rolled up plot of media 14 by pulling drive tubes 62 out of the ends of the rolled up plot. A motor, not shown, turns pinion gear 104 causing associated rack gears 106, 108 to urge right push rod 107 and left push rod 109 to push against the two slide brackets 94 on the right and left side of plotter 10 thus, pushing the two drive tubes 62 out from the inside of the rolled up plot. FIG. 4 shows the two drive tube assemblies 60 in their outward position. Each slide bracket 94 is limited to about 4 inches of motion from its furthest inward position to its furthest outward position.

Figure 6B:
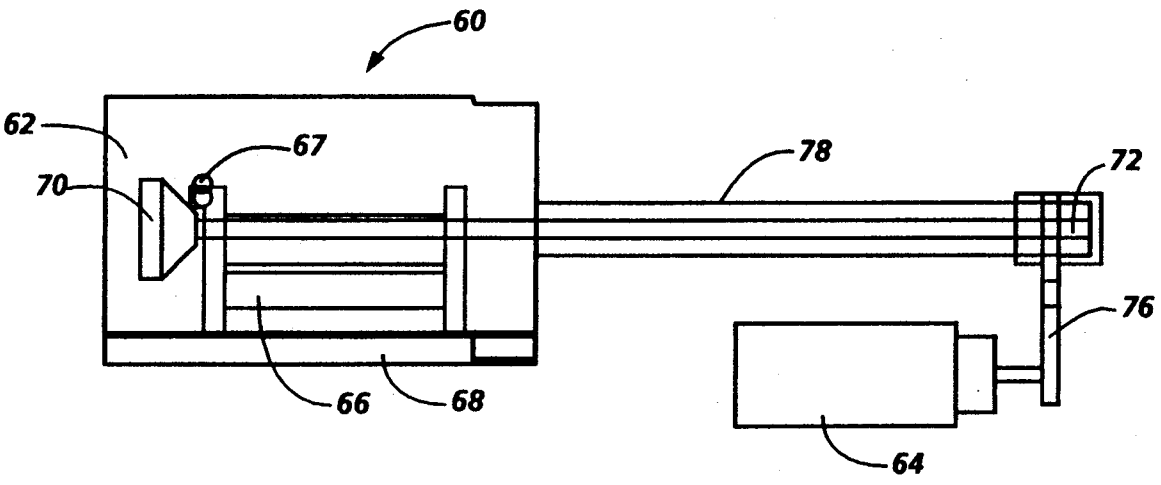
FIGS. 6*a* and 6*b* are detailed schematic views of the clamp drive tube assembly of the present invention in the media clamping position.
Figure 6A:
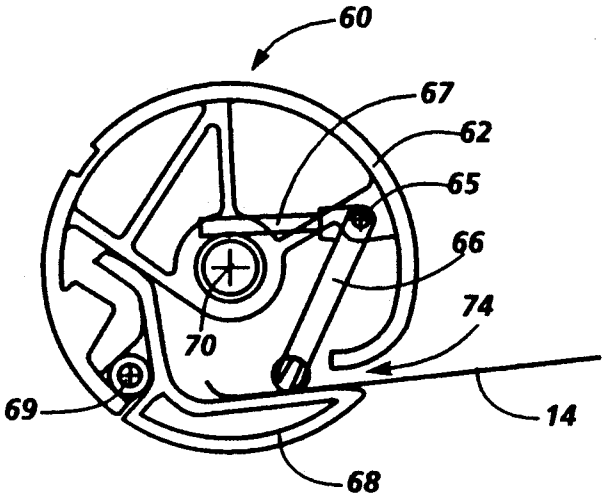

Turning now to a clamp tube assembly 60 as depicted in FIGS. 5–8. Clamp tube assembly 60 is a two piece aluminum die-cast member that provides the surface upon which media 14 is rolled. Internal to tube 60 is a simple pivoting clamp arm 66 that may be separated from clamp support 68 to provide a lengthwise slot or gap 74 within tube assembly 60 for media 14 to enter. Clamping and unclamping is achieved by energizing a push type solenoid 64 (as best seen in FIGS. 5*a* and 5*b*) which drives lever 76 and in turn drives rod 72 to move conical cam 70. Movement of cam 70 in the rightward direction (as viewed in FIG. 5) drives extension rod 67 radially outwardly thus pivoting clamp arm 66 counter clockwise (approximately 10–15 degrees) and opening gap 74. Conversely, movement of cam 70 in the leftward direction allows extension rod 67 to move radially inwardly for closing gap 74 and clamping the media as shown in FIG. 6.

In the clamping position of clamp arm 66, the clamp support 68 is urged radially outward thereby increasing the circumference of clamp tube assembly 60 to its maximum. By virtue of its geometry, clamp arm 66 self energizes so that the harder media 14 is pulled, the harder clamp arm 66 clamps on. When it is time to begin rolling media 14 about clamp drive tube assembly 60, the entire clamp drive tube assembly 60 starts rotating and that rotation, in effect, tugs on media 14 holding media 14 in place. The rotation is clockwise in the forward direction as seen from the right side and is controlled by differential drive assembly 80 discussed above.

Figure 7:
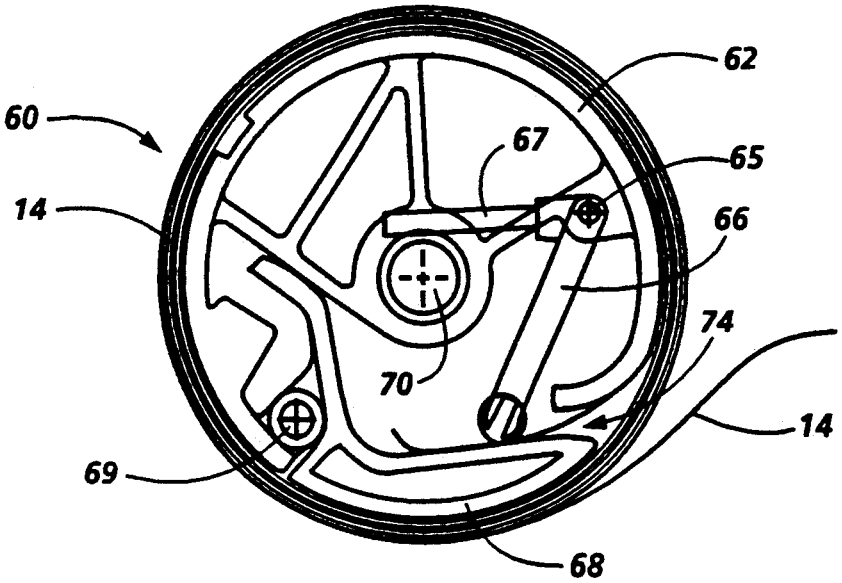
FIG. 7 is a schematic side view of the clamp drive tube assemble with media rolled thereon, where the media is still clamped.
Figure 8:
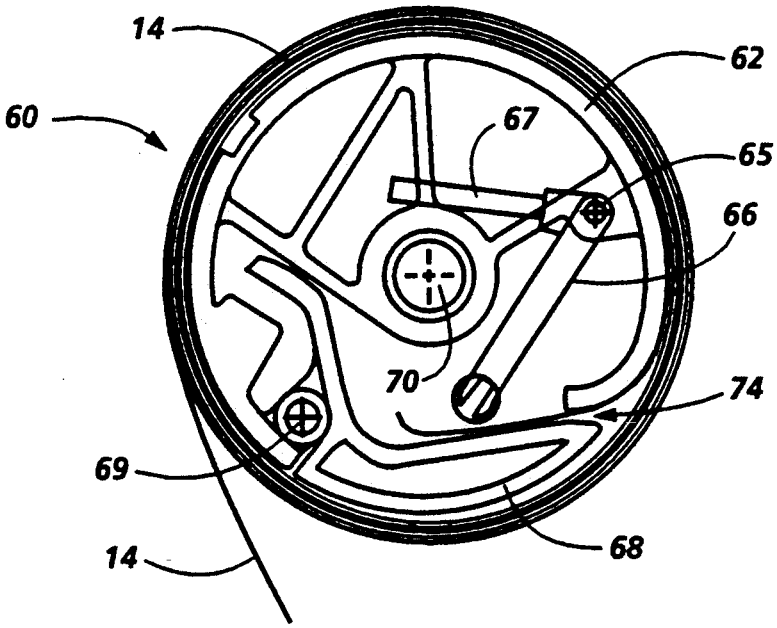
FIG. 8 is a schematic side view of the clamp drive tube assemble with media rolled thereon, where the media is unclamped.

Referring to FIG. 7, shown is clamp drive tube assembly 60 with media 14 rolled thereon and clamp arm 66 still in the clamped position. Once plotting is complete, media 14 is cut and clamp tube assembly 60 is rotated or indexed slightly such that the tail end of media 14 will be in a predetermined position as shown in FIG. 8. When media 14, which is now rolled onto clamp tube assembly 60, is ready to be released, the processor controlling plotter 10 will send a signal to unclamp clamp arm 66 of clamp drive tube assembly 60. As shown in FIG. 8, by unclamping clamp arm 66, clamp arm 66 will pivot about point 65 and will pull away from the surface of clamp support 68 releasing the leading edge of media 14 which has been thus far trapped. This allows clamp support 68 to pivot slightly radially inward about point 69, allowing the circumference of clamp tube assembly 60 to become reduced. It is this reduction in circumference that allows the two clamp drive tube assemblies 60 to be pulled out of the inside of the rolled up plot by retract assembly 100 as shown in FIG. 4 and discussed above.

In summary, and referring to FIGS. 1–8, before a plot begins, the leading edge of media 14 is at the edge of cutter assembly 50. Clamp arm 66 of clamp drive tube assembly is activated causing gap 74 for media entry. Media 14 is then indexed such that the leading edge of medium 14 enters gap 74 and clamp arm 66 is driven to trap the leading edge of media 14 within clamp drive tube assembly 60.

When plotting begins, differential assembly 80 provides equal torque to the two clamp drive tube assemblies 60 on both sides of plotter 10 causing clamp drive tube assemblies 60 to rotate and media 14 to roll thereon. With the assistance drive of assist drive rollers assembly 40, media 14 is rolled onto clamp drive tube assemblies 60 and repeatedly rewound back onto supply roll 16 according to the number of plotting passes required to complete a plot.

Once plotting has been completed, and media 14 is wound around clamp drive tube assemblies 60, cutter assembly 50 cuts media 14 and clamp drive tube assemblies 60 are indexed in order to position the trailing edge of the completed plot to a predetermined position. Clamp arm 66 is then released and clamp support 68 pivots inward. The release of clamp arm 66 causes the leading edge of rolled media to be let go and the pivoting of clamp support 68 causes the outer circumference of clamp drive tube assembly 80 to be reduced. Retract assembly 100 is then activated whereby pulling the two clamp drive tube assemblies out from rolled media 14 causing media 14 to drop into a bin on plotter 10.

While the invention has been described with reference to the structures disclosed, it is not confined to the details set forth, but is intended to cover such modifications or changes as may come within the scope of the following claims:

I claim:

1. An apparatus for automatically feeding and rolling output media from a printer, comprising:

supplying mechanism for supplying a recording media having a leading edge;

clamping mechanism for clamping side portions of said leading edge of said recording media, said clamping mechanism securing said media when clamped and releasing said media when unclamped, said clamping mechanism having a first circumferential surface when said clamping mechanism is clamped and a second circumferential surface when said clamping mechanism is unclamped;

first driving mechanism for driving said leading edge of said recording media into the interior of said clamping mechanism;

second driving mechanism for driving said clamping mechanism to allow said recording media to be rolled onto said first circumferential surface of said clamping mechanism; and retracting mechanism for removing said clamping mechanism from the interior of said recording media after said media has been rolled onto said clamping mechanism, causing said recording media to be unsupported.

2. An apparatus according to claim 1 wherein said second circumferential surface of said clamping mechanism is less than said first circumferential surface when said clamping mechanism unclamps said leading edge of said recording media.

3. An apparatus according to claim 1 wherein said retracting mechanism is retracted axially.

4. An apparatus according to claim 1 further comprising cutting mechanism for cutting said recording media.

5. An apparatus according to claim 1 wherein said second driving mechanism for driving said clamping mechanism is a differential drive.

6. A method for automatically feeding and rolling output media from a printer, including the steps of:

supplying a recording media having a leading edge;

driving said leading edge of said recording media into the interior of a clamping device, said clamping device securing said media when clamped and releasing said media when unclamped, said clamping device having a first circumferential surface when said clamping device is clamped and a second circumferential surface when said clamping device is unclamped;

clamping side portions of said leading edge of said recording media;

driving said clamping device to allow said recording media to be rolled onto said first circumferential surface of said clamping device;

rolling said recording media onto said first circumferential surface of said clamping device;

cutting said recording media;

unclamping said clamping device releasing said leading edge of said recording media; and retracting said clamping device and removing said clamping device from the interior of said recording media allowing said recording media to be unsupported.

7. A method according to claim 6 wherein said step of unclamping causes said second circumferential surface to be less than said first circumferential surface of said clamping device.

8. A method according to claim 6 wherein said step of driving said clamping device to allow said recording media to be rolled onto said clamping device is done differentially.

9. A method according to claim 6 wherein said step of retracting said clamping device causes said clamping device to be moved axially.

10. A method according to claim 6 including the step of indexing said clamping device after said cutting of said recording media.

* * * * *